United States Patent [19]

Maffei

[11] 4,311,245

[45] Jan. 19, 1982

[54] BABY BOTTLE FOR BOTTLE FEEDING AND OTHER USES

[76] Inventor: Carlo Maffei, Via Maestrale 10 bis, Pistoia, Italy

[21] Appl. No.: 79,578

[22] Filed: Sep. 27, 1979

[30] Foreign Application Priority Data

| | | | |
|---|---|---|---|
| Sep. 29, 1978 | [IT] | Italy | 9601 A/78 |
| Mar. 9, 1979 | [IT] | Italy | 9362 A/79 |
| Sep. 6, 1979 | [IT] | Italy | 9530 A/79 |

[51] Int. Cl.[3] ..... A61J 9/04

[52] U.S. Cl. ..... 215/11 B; 128/252

[58] Field of Search ..... 128/252; 215/11 B, 11 D, 215/11 R

[56] References Cited

U.S. PATENT DOCUMENTS

| | | | |
|---|---|---|---|
| 11,086 | 6/1890 | Eggers | 128/252 |
| 533,726 | 2/1895 | McBride | 215/11 B |
| 1,045,456 | 11/1912 | Tatum | 128/252 |
| 1,976,450 | 10/1934 | Lowe | 215/11 B |
| 2,066,445 | 1/1937 | Allen | 215/11 B |
| 2,094,721 | 10/1937 | Puetz | 215/11 B |
| 3,071,272 | 1/1963 | Doner | 215/11 B |
| 3,130,725 | 4/1964 | Griesinger | 128/252 |
| 3,232,466 | 2/1966 | Turanciol | 128/252 X |
| 3,424,157 | 1/1969 | Di Paolo | 128/252 |
| 3,924,620 | 12/1975 | Seunevel | 128/252 |

*Primary Examiner*—Donald F. Norton

*Attorney, Agent, or Firm*—McAulay, Fields, Fisher, Goldstein & Nissen

[57] ABSTRACT

A baby bottle for bottle feeding of the type wherein a rubber nipple is attached to the mouth of the bottle. An air valve is provided having a seat portion formed integrally with a wall of the bottle and a shutter portion adjustably engageable with said seat portion to operate the valve without interrupting sucking of the nipple by the baby. The nipple has a wall portion spaced away from the baby's mouth, and which wall portion has an outer configuration which varies to provide an indication of the vacuum existing inside the bottle and of tiring of the baby during sucking.

6 Claims, 8 Drawing Figures

BABY BOTTLE FOR BOTTLE FEEDING AND OTHER USES

BACKGROUND AND SUMMARY OF THE INVENTION

The invention relates to a baby bottle for bottle feeding and other uses; a valve, applied to the wall of the bottle, permits regulating, by manual control, the quantity of air which must replace the drained liquid relative to the vacuum created by the sucking; a zone of the nipple has an automatically variable geometry to evaluate the variation of this vacuum during continued sucking.

For bottle feeding one now uses a transparent, graduated bottle of glass, plastic, etc., to the mouth of which a nipple is applied with or without a valve which lets air enter during suckling. It is evident that in the absence of this valve, as in the case of baby bottles with inserted nipple, the air can get into the bottle only through the holes in the nipple. In any case the milk comes out of the nipple by effect of the infant's sucking, and for the external air to enter the bottle he must overcome the vacuum present therein, which depends, among other things, on the height of the liquid column, on the sensitivity of the air valve when there is one, and on the size and number of holes in the nipple.

This circumstance results in disadvantages such as the ingestion of air, making the infant tired, the necessity to use nipples of hard rubber, the formation of foam due to the bubbling or air through the milk. Besides, the types of air valve used nowadays in baby bottles are difficult to understand for most people, do not allow a good regulation of the outflow rate of the milk, require for their regulation taking the bottle out of the infant's mouth, and do not permit evaluation of the degree of vacuum existing in the bottle during the entire suckling period and therefore do not permit either verifying whether or not the arrangement in which the baby bottle operates is adequate to the infant's needs.

It is the object of the present invention to offer a remedy for all these disadvantages. As characterized in the claims, it solves the problem of introducing air into the baby bottle also in the presence of a slight vacuum, continuously displaying and visualizing the variation of this vacuum which occurs in the bottle as a result of the continued sucking. This is obtained by providing the bottle with a manual valve, applied fixed or removable, in the lateral or bottom wall, and forming the nipple with a zone whose geometry varies as the vacuum exisiting in the bottle varies during suckling.

The advantages obtained owing to this invention consist essentially in that the amount of air which enters the bottle without bubbling or almost so is manually adjustable without interrupting the suckling; the variation of the vacuum in the bottle during sucking is automatically and continuously indicated without external intervention, constituting on the one hand a means of visual indication when and how to act on the air valve and, on the other, a means for controlling the effect achieved by the action on the valve as well as the entire arrangement in which the baby bottle operates in relation to the infant's needs; it is made possible to give foods denser than milk and also medications, whether liquid, in powder form or gaseous, with or without addition of air. The invention will now be further described with reference to the attached drawings, which represent only a possible and non-limiting embodiment.

DESCRIPTION OF THE PREFERRED EMBODIMENTS

Figure 1:
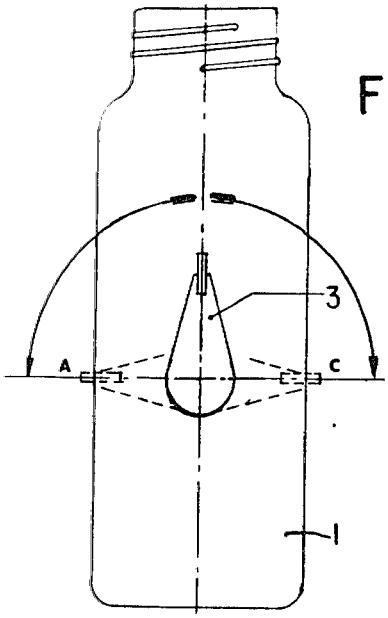
FIG. 1 represents a glass baby bottle according to the invention in which the air valve is in central position.
Figure 3:
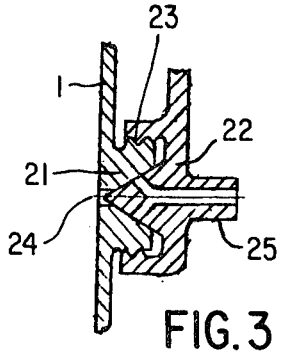
FIG. 3 represents a sectional view of a sample type of air valve for use with a glass bottle according to the invention.
Figure 2:
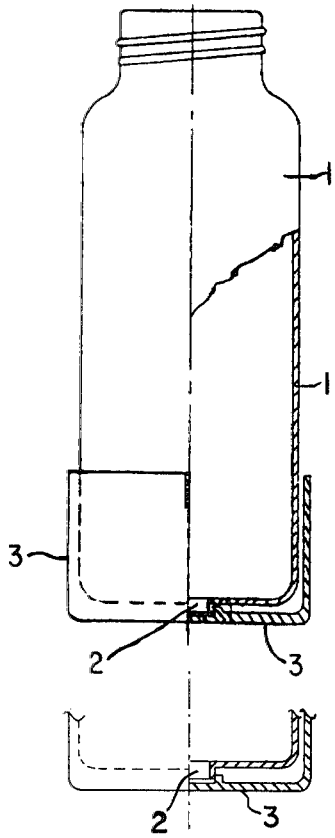
FIG. 2 represents the same bottle with the air valve disposed at the bottom.

The baby bottle according to the invention comprises a bottle and a nipple somehow to be applied to its mouth, as for example by screwing or coupling. The bottle illustrated in FIGS. 1 and 2, which is of the reusable glass type, comprises a cylindrical, transparent, graduated body (1), in whose lateral or bottom wall is an air valve (2) provided with a manual control device (3) rotating by 180° or by an angle of a different value, between two positions "A" for "fully open" and "C" for "fully closed"; each intermediate position corresponds to an intermediate value of valve opening. The neck of the bottle is threaded for the application of a nipple-holding ferrule; or else it is smooth for the application by coupling of a nipple without ferrule. Said valve (2), an example of which is given in FIG. 3, is made up of two elements; one (21), serving as seat, is fastened to the bottle or is integral with the body of the bottle, and the other (22), functioning as shutter, is engaged movable relative to the first by means of a screwthread (23) which is not hermetically tight and therefore constitutes an air path. The fixed and movable elements of the valve present contact surfaces of conical or other known form in use in cocks and with or without insertion of a gasket. The fixed and movable elements represent interfitting members disposed for relative movement between a contact or sealed position to close the valve, and a spaced apart or non-sealed position to open the valve, depending upon the position to which shutter element (22) is mounted to seat (21). There are one or more air paths (24) in one or both elements of the valve. The shutter element (22) may advantageously be provided with a pierced tang (25), to make an external attachment, intended for introducing into the bottle liquid and/or gaseous and/or pulverulent substances such as medications, whether or not added to the ambient air.

Figure 4:
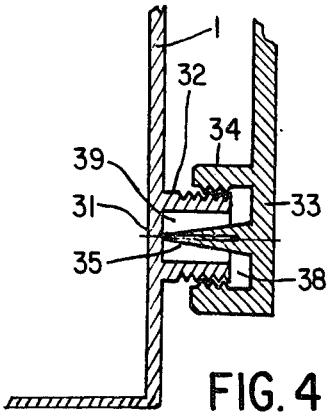
FIG. 4 represents a sectioned portion of a plastic bottle with fixed air valve whose air path is formed at the time of use.

The bottle illustrated in FIG. 4, which is of plastic or an easily pierceable material, comprises a body (1) of conventional form, from the lateral wall of which protrudes a short, externally threaded tube (32), which serves as fixed element of said air valve. The shutter element of this valve is a screw cap (33) attached to the tube (32) by the screwthread and from the base of which emerges a conical element (35) whose height is greater than that of the cap and whose tip has the function of opening an air path in the wall (31) of the bottle by the screwing on followed by unscrewing of the cap. After zone (31) of wall (1) has been punctured, air enters the bottle through the screwthread which is not hermetic and through the chambers (38) and (39). Complete closing of the valve is obtained by screwing the cap (33) all the way.

Said shutter element (33) can advantageously be used to cause the opening of the container before use, piercing also the mouth thereof when it is a container already made up with a pre-established dose of liquid.

Figure 5:
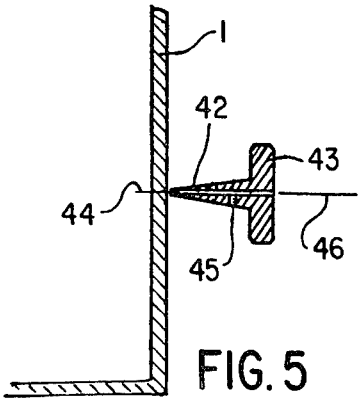
FIG. 5 represents a sectioned portion of a plastic bottle with removable and installable air valve.

The bottle illustrated in FIG. 5, which is of the disposable type of plastic or other easily pierceable material, is equipped with a punch element, of metal or other rigid material, having a cuneiform stem (42) of slight conicity and a cylindrical, enlarged head (43); a small hole (44) passing longitudinally through the stem and through the head, in cooperation with one or more transverse holes (45) but communicating with the former (44) establish the air path or paths, after the stem of the punch element has been installed in the wall of the bottle; probe means (46) being provided to make sure of the perviousness of the hole (44) and to regulate its closing.

Figure 6:
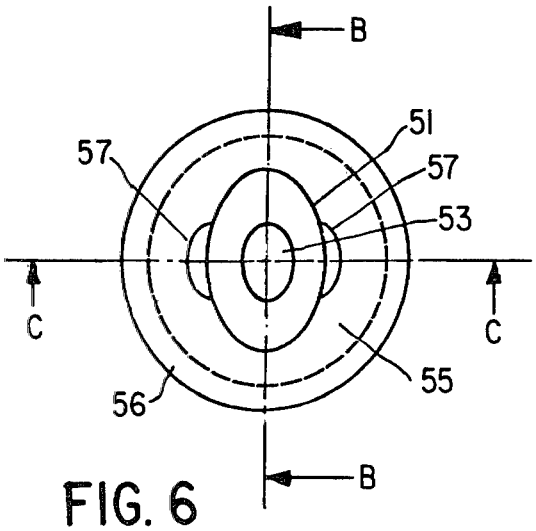
FIG. 6 represents the plan view of a baby bottle nipple according to the invention.
Figure 7:
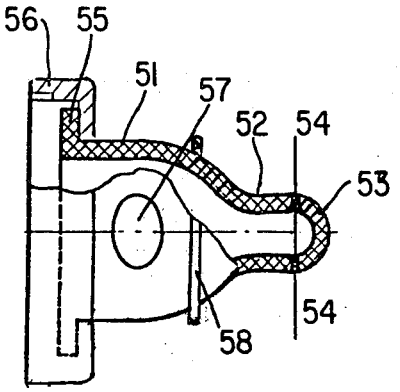
FIG. 7 represents the section along BB in FIG. 6.
Figure 8:
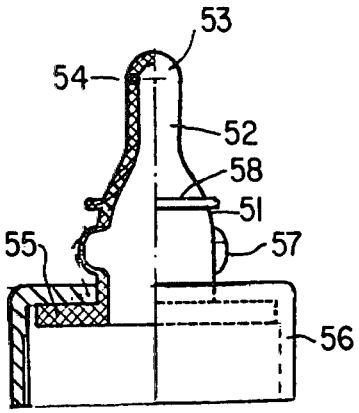
FIG. 8 represents the section along CC in FIG. 6.

The nipple illustrated in FIGS. 6, 7 and 8 comprises: a body of soft rubber with the base (51), narrow upper projection (52) and terminal button (53) which have an elliptical cross-section at all points of the longitudinal axis; a circular flange (55) joined to the base (51); a ferrule (56) for application to a bottle with screw-on neck. In the plumper zones of the base (51) an external bulge (57) is provided, open toward the inside and very thin, thinner than the other parts of the nipple. Said bulges (57) have a variable geometry and undergo variations of curvature in relation to the variations of the vacuum existing inside the bottle during sucking. In particular, increasing vacuum first produces the flattening of the wall and then its swelling toward the interior. In other words, the bulges (57) represent a wall portion of the nipple which has an outer configuration which varies, as by being displaced inwardly, to provide an indication of the vacuum existing inside the bottle during sucking. Instead of the bulges (57) it is provided to form a corresponding zone of the base (51) thinner than the other zones of the nipple. It is advantageous also to provide the nipple with an annular projection (58) so that said bulges (57) will remain outside the infant's mouth and also in order that the nipple will not be introduced too deeply.

It is also advantageous for the holes (54) in the button (53) to be lateral so that the liquid will gush into the mouth in the direction of the cheeks.

I claim:

1. A baby bottle for bottle feeding of the type wherein a rubber nipple is attached to the mouth of the bottle, said bottle having an air valve made up of a seat portion formed integrally with a wall of said bottle and a shutter portion adjustably engageable with said seat portion to operate said valve without interrupting sucking of said nipple by the baby, said nipple having an apertured end portion adapted to be received in the baby's mouth for sucking and a wall portion spaced away from said end portion so as not to engage the baby's mouth when sucking, and said wall portion having an outer configuration which varies to provide an indication of a vacuum existing inside said bottle during sucking.

2. The baby bottle as recited in claim 1 wherein said wall portion of said nipple is of reduced thickness as compared to the wall thickness of the remainder of said nipple.

3. The baby bottle as recited in claim 2 wherein said nipple wall portion which is of reduced thickness is shaped to form an external bulge adapted to be displaced inwardly of said nipple as the vacuum inside the bottle increases during sucking.

4. In a baby bottle for bottle feeding of the type wherein a perforated rubber nipple is connected to the mouth of the bottle, and a valve is connected to a wall of said bottle to provide an air vent passageway to facilitate nursing of the baby, wherein the improvement comprises:

a perforated seat portion for said valve formed integrally with the wall of said bottle to define said passageway, and a shutter portion engageable with said seat portion;

fastening means for adjustably mounting said shutter to said seat;

interfitting means on said seat and said shutter disposed for relative movement thereof between a sealed position to close said valve and a non-sealed position to open said valve for regulating flow through said passageway, said relative movement being controlled by the position to which said shutter is mounted to said seat;

said nipple comprising an apertured button end portion adapted to be received in the baby's mouth for sucking and a base portion spaced from said mouth sucking button end portion; and, said base having a wall portion of reduced thickness as compared to the wall thickness of the remainder of said nipple, said reduced wall thickness portion being displaced to a position indicative of the vacuum existing inside said bottle during sucking, whereby said valve is effective to reduce the vacuum in said bottle to a level to prevent collapsing of the nipple and thereby to prevent tiring of the baby during sucking so as to permit the baby to suck from said nipple continuously with little strength and without having to remove the bottle to reduce the vacuum.

5. The baby bottle as recited in claim 4, wherein said fastening means comprise non-hermetic screwthreads.

6. The baby bottle as recited in claim 4 wherein said interfitting means comprise a surface portion of said shutter located sealingly to engage with an opposing surface portion of said seat upon relative movement thereof in one direction to close said valve, said opposing surfaces are disengaged from each other upon relative movement of said shutter and said seat in an opposite direction to open said valve.

* * * * *